US008477164B2

(12) United States Patent
Kawamorita

(10) Patent No.: US 8,477,164 B2
(45) Date of Patent: Jul. 2, 2013

(54) PRINTER

(75) Inventor: Yuji Kawamorita, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/161,681

(22) Filed: Jun. 16, 2011

(65) Prior Publication Data

US 2012/0038734 A1 Feb. 16, 2012

(30) Foreign Application Priority Data

Aug. 10, 2010 (JP) ..... 2010-179580

(51) Int. Cl.
*B41J 25/304* (2006.01)

(52) U.S. Cl.
USPC ..... 347/198; 400/120.17

(58) Field of Classification Search
USPC ..... 347/197, 198; 400/120.16, 120.17
See application file for complete search history.

(56) References Cited

U.S. PATENT DOCUMENTS 5,612,727 A * 3/1997 Morimoto et al. ..... 347/198
5,678,936 A * 10/1997 Hino ..... 400/55
6,549,224 B2 * 4/2003 Connor ..... 347/198
6,788,326 B2 * 9/2004 Sasaki ..... 347/198
7,283,147 B2 * 10/2007 Sago et al. ..... 347/198
8,282,295 B2 * 10/2012 Chen ..... 400/120.17
2012/0026268 A1 * 2/2012 Watson et al. ..... 347/198

FOREIGN PATENT DOCUMENTS

JP 10-181148 * 7/1998
JP 04-232087 * 8/1998
JP 2004-058553 2/2004

OTHER PUBLICATIONS

Machine-generated translation of JP 10-181148, published on Jul. 1998.*
Machine-generated translation of JP 2004-058553, published on Feb. 2004.*

* cited by examiner

*Primary Examiner* — Huan Tran
(74) *Attorney, Agent, or Firm* — Turocy & Watson, LLP

(57) ABSTRACT

Embodiments described herein are related to a printer including a thermal head, a platen roller, a plurality of biasing members, and an urging force adjustment mechanism. The urging force adjustment mechanism includes a base member, an action member movable in the widthwise direction with respect to the base member and configured to expand or compress the plurality of biasing members, and a plurality of contact members configured to contact the action member and supported by the base member such that contact positions of the contact members on the action member can be varied in the expansion or compression direction of the biasing members, wherein the amount of expansion or compression of the biasing members varies according to the variation of the contact positions.

18 Claims, 9 Drawing Sheets

PRINTER

CROSS-REFERENCE TO RELATED APPLICATIONS

This application is based upon and claims the benefit of priority from Japanese Patent Application No. 2010-179580, filed on Aug. 10, 2010, the entire contents of which are incorporated herein by reference.

FIELD

Embodiments described herein relate generally to a printer.

BACKGROUND

In the related art, there is known a printer in which a thermal head is urged against a platen roller by means of a biasing member.

In some cases, in such a type of printer, the force required for urging the thermal head against the platen roller needs to be applied differently on a strip-shaped material in a widthwise direction thereof.

DETAILED DESCRIPTION

Figure 1:
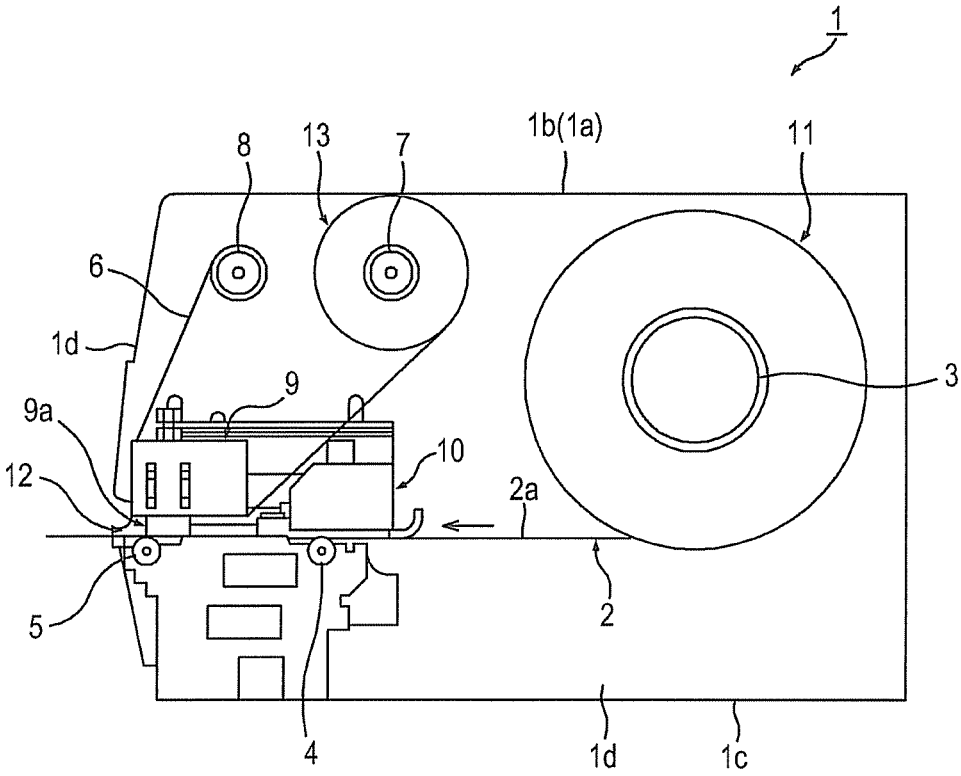
FIG. 1 is a side view showing an exemplary structure of a printer according to a first embodiment.

According to one embodiment, a printer comprising a thermal head extending in a widthwise direction of a strip-shaped material; a platen roller facing the thermal head and extending in the widthwise direction; a plurality of biasing members arranged apart from each other in the widthwise direction and configured to urge the thermal head against the platen roller by an elastic force made by expansion or compression; and an urging force adjustment mechanism configured to vary the urging force of the thermal head against the platen roller by varying the amount of expansion or compression of the plurality of biasing members. The urging force adjustment mechanism including: a base member; an action member movable in the widthwise direction with respect to the base member and configured to expand or compress the plurality of biasing members; and a plurality of contact members configured to contact the action member and supported by the base member such that contact positions of the contact members on the action member can be varied in the expansion or compression direction of the biasing members, wherein the amount of expansion or compression of the biasing members varies according to the variation of the contact positions.

Embodiments will now be described in detail with reference to the drawings. Embodiments to be described below may include the same elements. Therefore, in the following description, the same elements are denoted by the same reference numerals and explanation thereof will not be repeated.

As shown in FIG. 1, a printer 1 of an illustrative embodiment may print on a label (used as a printing medium), provided on (e.g., adhered to) an inner surface 2*a* of a strip-shaped paper 2 (used as a strip-shaped material). In some embodiments, the printer 1 may perform printing on a printing medium other than a label, for example, a continuous-form paper without a backing sheet. In addition, the printer 1 may have a function of writing and reading data to and from an RFID (Radio Frequency IDentification) chip provided on a label.

A main body 1*a* of the printer 1 may include a housing 1*b* with a bottom wall 1*c* and a side wall (not shown). The housing 1*b* includes a longitudinal wall 1*d* perpendicular to the bottom wall 1*c* and also parallel to the side wall. On the longitudinal wall 1*d*, a roll holding shaft 3, a conveying roller 4, a platen roller 5, a supply shaft 7 for an ink ribbon 6, a take-up shaft 8 for the ink ribbon 6, a print block 9, a pinch roller block 10 and the like are mounted perpendicular to the longitudinal wall 1*d*. In addition, a control circuit (not shown) is disposed on the rear side of the longitudinal wall 1*d* in the housing 1*b*, as seen from a front side of the plane view of FIG. 1.

The roll holding shaft 3 may rotatably hold a roll (e.g., paper roll) 11, around which the strip-shaped paper 2 is wound, in a state perpendicular to the plane of FIG. 1. In one embodiment, the roll holding shaft 3 may be rotatably supported by the longitudinal wall 1*d*. Alternatively, the roll holding shaft 3 may be fixed on the longitudinal wall 1*d*, thereby allowing the paper roll 11 wound with the strip-shaped paper 2 to rotate around the roll holding shaft 3. In any of the above embodiments, the roll holding shaft 3 and the paper roll 11 are not driven by, for example, a motor. The paper roll 11 wound with the strip-shaped paper 2 rotates (or is driven) in conjunction with rotation of the conveying roller 4 and the platen roller 5, which are provided at the downstream side of the paper roll 11 in a paper feeding direction (the left direction in FIG. 1). As a result, the strip-shaped paper 2 is discharged from the paper roll 11.

The conveying roller 4 and the platen roller 5 may be rotary-driven by means of, for example, a motor (not shown). The conveying roller 4 is provided at the upstream side of the platen roller 5 and the print unit 12 in the paper feeding direction. The pinch roller block 10 may include a pinch roller (not shown) which is horizontally placed adjacent to the conveying roller 4 along the paper feeding direction. The pinch roller is urged against the conveying roller 4 with a predetermined pressure. The strip-shaped paper 2, interposed between the conveying roller 4 and the pinch roller, is conveyed in the paper feeding direction in conjunction with the rotation of the conveying roller 4. In this embodiment, the conveying roller 4, the platen roller 5, the motor, a motor controller (not shown) and the pinch roller block 10 may constitute a conveying mechanism.

A ribbon roll 13, around which a strip-shaped material (e.g., ink ribbon 6) is wound, is held by the supply shaft 7 of the ink ribbon 6. The take-up shaft 8 may be rotary-driven by means of, for example, the motor. With the rotation of the take-up shaft 8, the ink ribbon 6 is discharged from the ribbon roll 13 and wound around the take-up shaft 8. Both the ink ribbon 6 and the strip-shaped paper 2 are interposed between a thermal head 9*a* included in the print head block 9 and the platen roller 5. The thermal head 9*a* generates heat, which allows ink residing on the ink ribbon 6 to melt or sublimate. Through such operation of the thermal head 9*a*, a predetermined pattern such as a character, numeric character, bar code, or graphic, is transferred onto a label which is provided (e.g., attached to) on a surface of the strip-shaped paper 2 (e.g., the inner surface 2*a*). In this embodiment, a print mechanism may include the ink ribbon 6, the supply shaft 7, the take-up shaft 8, the print block 9, the thermal head 9*a*, the motor (not shown), and the motor controller (not shown). The print unit 12 may include the thermal head 9*a* and the platen roller 5.

As shown in FIGS. 2 to 5, the print block 9 includes the thermal head 9*a*, a base member 14, a coil spring 15, an action member 16, and screws 17. Among the above elements, the base member 14, the action member 16, and the screws 17 may constitute an urging force adjustment mechanism 20, which variably sets the length of the coil spring 15, thereby adjusting the urging force of the thermal head 9*a* against the platen roller 5 by means of an elastic force of the coil spring 15.

The base member 14 is supported by the longitudinal wall 1*d* (see FIG. 1) and, at least during a printing operation, is fixed to the longitudinal wall 1*d*. The base member 14 includes an elongated rectangular or plate-shaped top wall 14*a* extending in the widthwise direction of the strip-shaped paper 2 and the ink ribbon 6 (horizontal direction, i.e., X direction, in FIG. 2), and a pair of rectangular or plate-shaped side walls 14*b* extending from both end portions of the top wall 14*a* (in the widthwise direction) toward the thermal head 9*a*. In one embodiment, the base member 14 may be formed in an approximately reverse-U shape when the front side of the base member 14 is viewed from the downstream of the conveying direction of the strip-shaped paper 2 and the ink ribbon 6.

Figure 3:
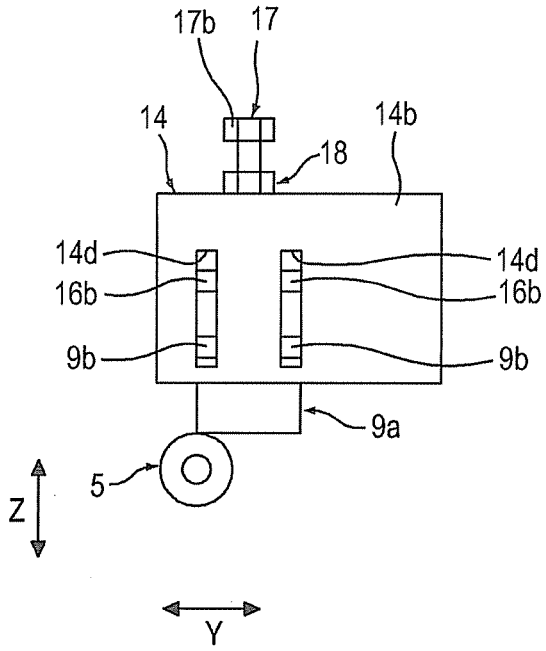
FIG. 3 is a side view of a head block of the printer.

The base member 14 supports the thermal head 9*a*, the action member 16 and the screws 17. As shown in FIG. 3, elongated slits 14*d* are used as through-holes and respectively formed on the side walls 14*b* in the vertical direction of FIG. 3 (expansion/compression direction of the coil spring 15, i.e., Z direction). Arm sections 9*b* protruding from both end portions of the thermal head 9*a* in the X direction of the thermal head 9*a* (i.e., the longitudinal direction of the thermal head 9*a*) and arm sections 16*b* protruding from both end portions of the action member 16 in the X direction of the action member 16 (i.e., the longitudinal direction of the action member 16) pass through the slits 14*d* respectively. As shown in FIG. 3, the slits 14*d* allow the arm sections 9*b* and 16*b* to move in the Z direction (i.e., the longitudinal direction of the slits 14*d*) and regulate the movement of the arm sections 9*b* and 16*b* in the Y direction (i.e., the horizontal direction in FIG. 3 or the conveying direction of the strip-shaped paper 2 and the ink ribbon 6). In addition, the slits 14*d* regulate rotation of the arm sections 9*b* and 16*b* around their axes extending in the X direction. Accordingly, edges of the side walls 14*b* forming the slits 14*d* act as guide rails which guide the thermal head 9*a* and the action member 16 to move up and down in the Z direction. In this embodiment, the side walls 14*b* correspond to a second support section.

Figure 2:
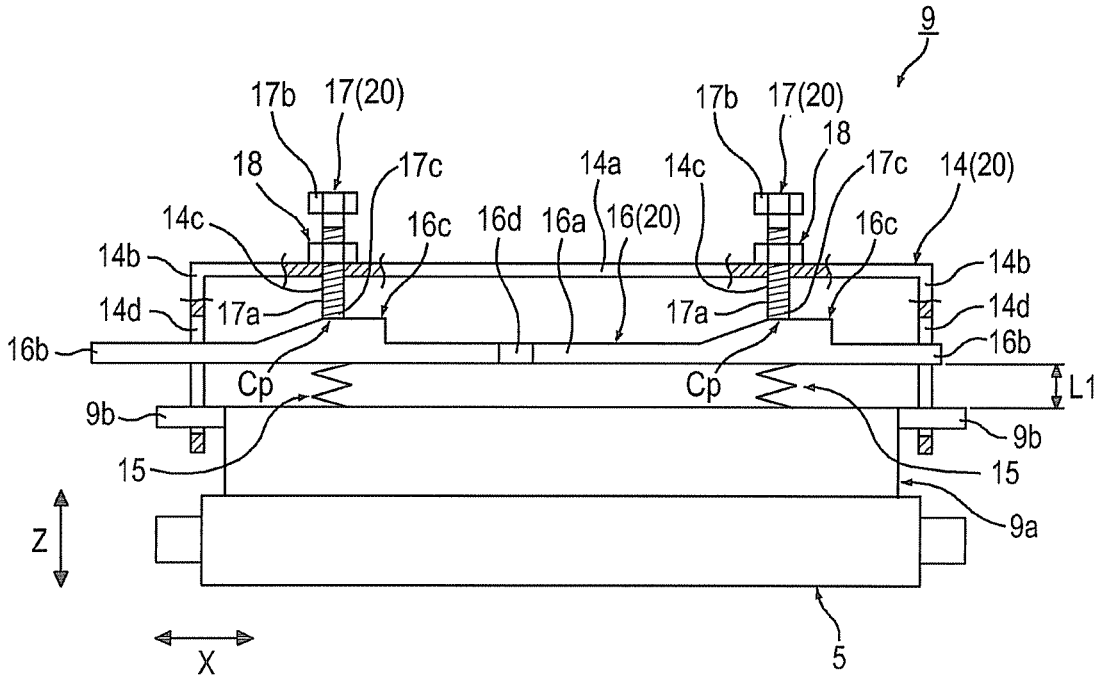
FIG. 2 is a schematic front view (partial sectional view) of a head block of the printer, showing a state where an action member is located at one side in a widthwise direction.

As shown in FIG. 2, a plurality of female screw holes 14*c* spaced apart from each other in the X direction is formed on the top wall 14*a*. In this embodiment, the female screw holes 14*c* are respectively formed at one position and at another position in symmetry with respect to the center of the thermal head 9*a* in the X direction (the widthwise direction of the strip-shaped paper 2 and the ink ribbon 6). Screws 17, each of which has a screw thread 17*a* and a head 17*b*, are respectively inserted in the female screw holes 14*c*. In addition, the screws 17 are respectively inserted in locknuts 18. Accordingly, an operator can turn the screws 17 to adjust the protruding length of the screws 17 extending from the top wall 14*a* to the side of the thermal head 9*a* and then tighten the locknuts 18 and as a result, the screws 17 are secured to the top wall 14*a* with the screws 17 protruding from the top wall 14*a* by a desired length (protruding length). Leading end portions 17*c* of the screws 17 contact the action member 16. In this embodiment, the screws 17 correspond to a contact member.

The action member 16 has a strip-shaped base section 16*a* extending in the X direction and is arranged in parallel to the thermal head 9*a* in the Z direction (vertical direction), with the thermal head 9*a* interposed between the action member 16 and the platen roller 5. In addition, the coil spring 15 (as a biasing member) is interposed between the action member 16 and the thermal head 9*a*. In this embodiment, the coil spring 15 is implemented using a compression spring. A plurality of coil springs 15 may be arranged apart from each other in the X direction. In this embodiment, two coil springs 15 are arranged at one position and at the other position in symmetry with respect to the center of the thermal head 9*a* in the X direction (the widthwise direction of the strip-shaped paper 2 and the ink ribbon 6). In addition, the coil springs 15 are respectively arranged along a line extending from the screw threads 17*a* of the screws 17.

In the above configuration of this embodiment, the elastic force of the coil spring 15 is exerted on the thermal head 9*a* to allow the thermal head 9*a* to move toward the platen roller 5. That is, the thermal head 9*a* is biased to the platen roller 5 by means of the coil spring 15 (used as a biasing member).

Figure 4:
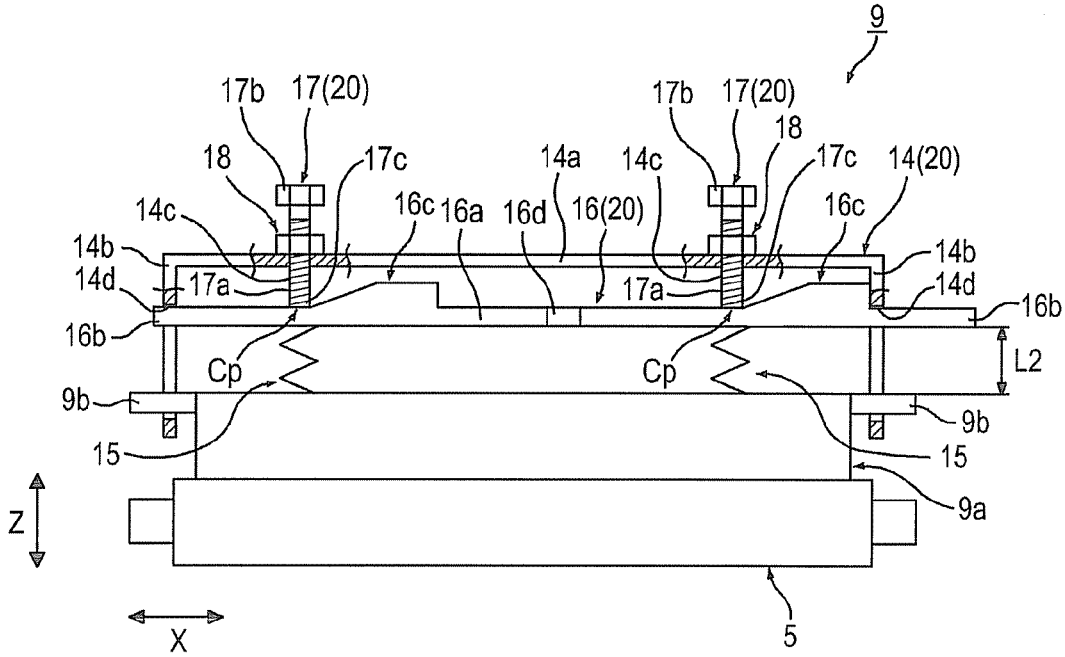
FIG. 4 is a schematic front view (partial sectional view) of the head block of the printer, showing a state where the action member is located at the other side in the widthwise direction.

In the embodiment as shown in FIG. 2, protruding portions 16*c* which bulge toward the screws 17 respectively are formed on the action member 16 at contact positions Cp which contact the leading end portions 17*c* of the screws 17 (used as contact members). In this embodiment, the protruding portions 16*c* correspond to protruding sections. As shown in FIGS. 2 and 4, the arrangement of the action member 16 in the X direction may be varied to switch between a state where the screws 17 contact the top portions of the protruding portions 16*c*, as shown in FIG. 2, and a state where the screws 17 contact the base sections 16*a* instead of the protruding portions 16*c*, as shown in FIG. 4. As shown in FIG. 2, in the state where the leading end portions 17*c* of the screws 17 contact the protruding portions 16*c*, the action member 16 is more biased toward the thermal head 9*a* and the length L1 of the coil spring 15 (i.e. a space in which the coil spring 15 is disposed) in the Z direction is decreased, such that the elastic force of the coil spring 15 is increased. On the other hand, as shown in FIG. 4, in the state where the screws 17 contact the base sections 16*a* instead of the protruding portions 16*c*, the action member 16 recedes from the thermal head 9*a* and the length L2 of the coil spring 15 (i.e. the space in which the coil spring 15 is disposed) in the Z direction is increased (L2>L1), such that the elastic force of the coil spring 15 is decreased. Accordingly, in this embodiment, an operator may vary the length of the coil spring 15 (i.e. the space in which the coil spring 15 is disposed) used as the biasing member in the Z direction by moving the position of the action member 16 in the X direction and varying the relative positional relationship between the screws 17 used as the contact members and the protruding portions 16*c* used as the protruding sections (or groove portions to be described later). Further, the operator may adjust the elastic force by the coil spring 15 by varying the length of the coil spring 15 and accordingly can adjust an urging force of the thermal head 9*a* against the platen roller 5. In addition, in this embodiment, a grasping section 16*d* protruding laterally (in the Y direction) is formed in the action member 16. The operator may grasp the grasping section 16*d* to move the action member 16 in the X direction. Further, the thermal head 9*a* and the coil spring 15 are configured to be stationary despite the movement of the action member 16. This configuration may be implemented by, for example, providing a mechanism (not shown) of engaging the base member 14 with the thermal head 9*a* or a mechanism (not shown) of engaging the thermal head 9*a* with the coil spring 15. Further, in the examples of FIGS. 2 and 4, the protrusion lengths of the two screws 17 extending from the top wall 14*a* are equal to each other, such that the urging force of the thermal head 9*a* against the platen roller 5 is substantially constant in the X direction.

Figure 5:
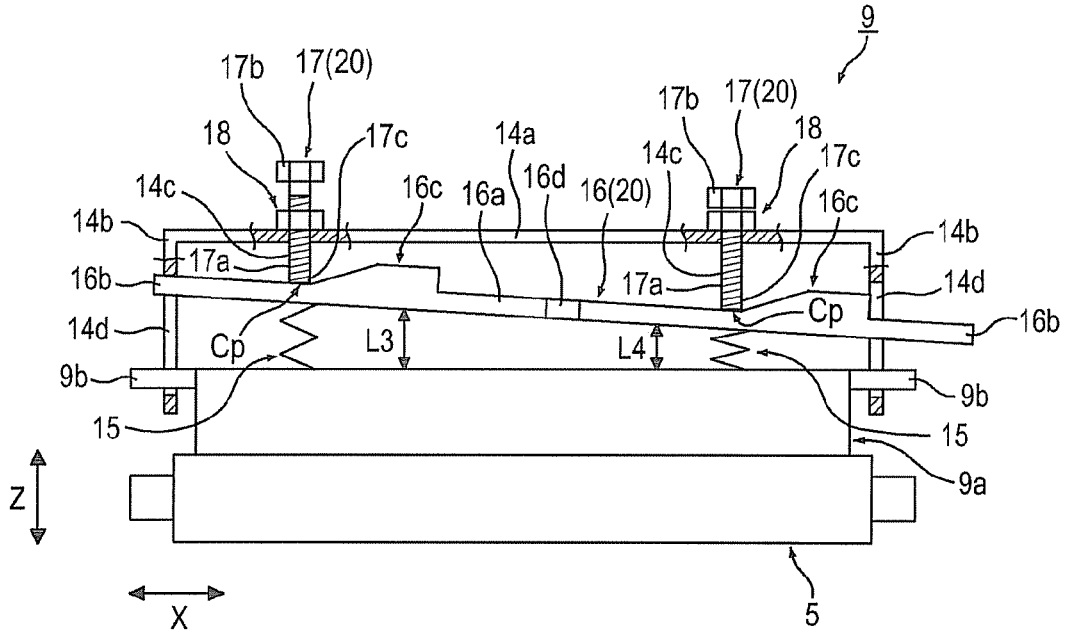
FIG. 5 is a schematic front view (partial sectional view) of the head block of the printer, showing a state where protrusion lengths of two contact members are different.

Alternatively, as shown in FIG. 5, an operator may adjust the lengths of the plurality of coil springs (for example, the two coil springs in this embodiment which are arranged apart from each other in the X direction) (i.e., the space in which the coil springs 15 are disposed) in the Z direction by varying the protrusion lengths of the plurality of screws 17 (for example, the two screws in this embodiment which are arranged apart from each other in the X direction) extending from the top wall 14*a*. In this manner, the operator may change the urging force of the thermal head 9*a* against the platen roller 5 by the coil springs 15 (used as the biasing members) in the X direction. In the state shown in FIG. 5, since the length L4 of the right coil spring 15 (i.e. the space in which the right coil spring 15 is disposed) in the Z direction is smaller than the length L3 of the left coil spring 15 (i.e. the space in which the left coil spring 15 is disposed) in the Z direction, the biasing force of the right coil spring 15 is larger than the biasing force of the left coil spring 15. Accordingly, in this case, the urging force of the thermal head 9*a* against the platen roller 5 is larger on the right-hand side of FIG. 5 in the X direction (i.e., the widthwise direction of the strip-shaped paper 2 or the ink ribbon 6), while the urging force is smaller on the left-hand side of FIG. 5 in the X direction. Thus, for example, when printing on a strip-shaped paper 2 having a thickness varying along the X direction, a quality printing can be produced by preventing the urging force of the thermal head 9*a* applied against the platen roller 5 from being dispersed (irregularly distributed) in the X direction.

Figure 6:
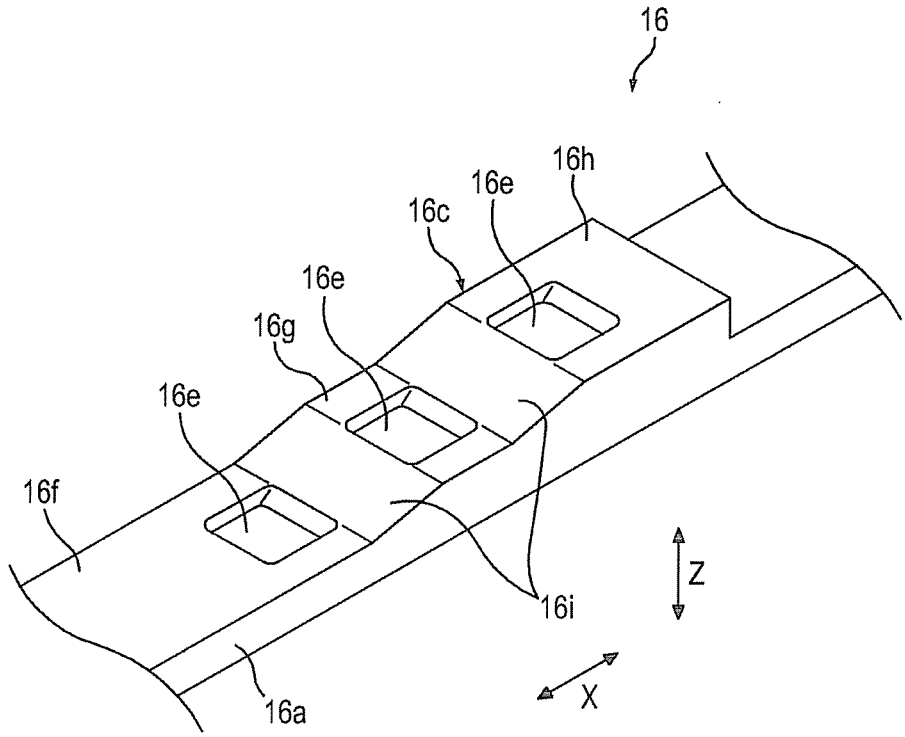
FIG. 6 is a perspective view showing a protruding portion formed in the action member of the printer.

In one embodiment, as illustrated in FIG. 6, groove portions 16*e* may be formed on the protruding portion 16*c* to accommodate the leading end portion 17*c* of a screw 17 (used as the contact member) and regulate movement of the screw 17 in the X or Y direction. In this configuration, the relative positional relationship between the action member 16 and the screw 17 can be easily maintained. In addition, the groove portions 16*e* correspond to a support section which supports the screw 17 used as the contact member. Further, in some embodiments, as illustrated in FIG. 6, a first groove portion 16*e* may be formed on the surface 16*f* of the base section 16*a* and a second groove portion 16*e* may be formed on the top surface 16*h* of the protruding portion 16*c*, while a third groove portion 16*e* may be formed at a height between the first and second groove portions. By employing the above arrangement, it is possible to adjust the urging force of the thermal head 9*a* against the platen roller 5 in a multi-stepwise manner. Accordingly, in this embodiment, a plurality of groove portions 16*e* (used as support sections) is formed on the action member 16 at different support positions in the Z direction. In this embodiment, the third groove portion 16*e* located between the first and second groove portions may be formed on a step surface 16*g* formed between two inclined surfaces 16*i*. Since the height of the plurality of groove portions 16*e* increases or decreases in a stepwise manner in the X direction, an operator may increase or decrease the urging force of the thermal head 9*a* against the platen roller 5 by adjusting the movement direction of the action member 16 along the X direction.

The printer 1 according to the above embodiment includes the urging force adjustment mechanism 20 to adjust the urging force of the thermal head 9*a* against the platen roller 5 by varying the amount of compression of the coil springs 15 used as the plurality of biasing members. The urging force adjustment mechanism 20 includes the base member 14, the action member 16, the plurality of screws 17 used as the contact members, and the protruding portions 16*c* used as the protruding sections formed on the action member 16. The action member 16 is arranged in such a manner that the position of the action member 16 relative to the base member 14 in the X direction (the widthwise direction of the strip-shaped paper 2 or the ink ribbon 6) can be varied, thereby expanding or compressing the plurality of coil springs 15. Each of the plurality of screws 17 contacts the action member 16 and is supported by the base member 14 in such a manner that the contact position Cp contacting the action member 16 can be variably set in the Z direction (i.e., the compression direction of the coil spring 15). The compression of the coil spring 15 by the action member 16 is variably set by variably setting the contact position Cp. In addition, the protruding portions 16*c* used as the protruding sections are formed in the action member 16 at contact positions (where the action member 16 may contact the screws 17) so that the protruding portions 16*c* protrude from the action member 16 in the Z direction. In addition, the compression of the coil spring 15 by the action member 16 can be variably set by varying the position of the action member 16 with respect to the base member 14 in the X direction. Thus, in this embodiment, the magnitude of the biasing force of the coil spring 15 can be easily adjusted by the positional adjustment of the action member 16 in the X direction in addition to the adjustment of the contact positions of the plurality of screws 17 with respect to the base member 14. Further, in the above adjustment configuration, an urging force of the thermal head 9*a* against the platen roller 5 can be distributed in various ways.

In addition, the printer 1 according to this embodiment includes a plurality of contact members: the screw 17 (used as the first contact member) is configured to contact the action member 16 at one side thereof with respect to the center of the thermal head 9*a* in the X direction (the widthwise direction of the strip-shaped paper 2 or the ink ribbon 6) and the screw 17 (used as the second contact member) is configured to contact the action member 16 at the other side thereof with respect to the center of the thermal head 9*a* in the X direction. Accordingly, the urging force of the thermal head 9*a* against the platen roller 5 may be adjusted differently along the X direction. For example, the urging force of the thermal head 9*a* against the platen roller 5 may be increased (or decreased) on one side of the thermal head 9*a* in the X direction while the urging force of the thermal head 9*a* against the platen roller 5 may be decreased (or increased) on the other side of the thermal head 9*a* in the X direction.

In addition, the printer 1 according to this embodiment includes the protruding portions 16*c* (used as the protruding sections), each of which is formed to correspond to a screw 17 (used as the plurality of contact members). Accordingly, the operator can easily set the urging force of the thermal head 9*a* against the platen roller 5 such that the variation of the urging force can be applied equally to the plurality of screws 17 as the action member 16 moves in the X direction. For example, the protruding portions 16*c* may be formed to have the same shape (or same profile) to contact the corresponding screws 17 as described above. In this configuration, the action member 16 may be used to uniformly apply the variation of the urging force of the thermal head 9*a* against the platen roller 5 in the X direction without a difference in the urging force applied along the X direction. In this case, each of the screws 17 may be used to vary the urging force along the X direction.

Furthermore, in this embodiment, since the protrusion of the protruding portions 16*c* may be adjusted in a stepwise manner in the X direction, the operator may adjust the length of the coil spring 15 (i.e. the space in which the coil spring 15 is disposed) in the Z direction and thus adjust the magnitude of the urging force of the thermal head 9*a* against the platen roller 5 applied by the coil spring 15, by appropriately moving the action member 16 in the X direction.

In addition, in this embodiment, the groove portions 16*e* (the support sections) are formed on the action member 16 to support the screws 17 (the contact members). Accordingly, it is possible to prevent a variation in the urging force of the thermal head 9*a* against the platen roller 5 along the X direction that may result from a deviation of the position of the action member 16 with respect to the screws 17.

Further, in this embodiment, the groove portions 16*e* (used as the plurality of support sections) configured to support the contact members at different positions along the Z direction are formed in the action member 16. Accordingly, the urging force of the thermal head 9*a* against the platen roller 5 may be adjusted in a multi-stepwise manner.

Figure 7:
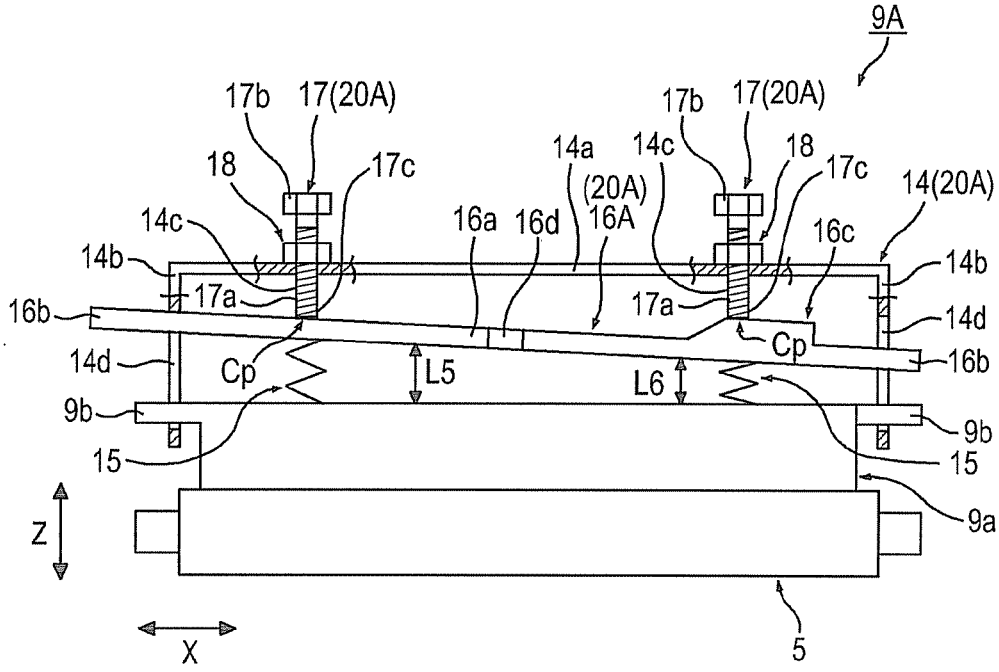
FIG. 7 is a schematic front view (partial sectional view) of a head block of a printer according to a second embodiment, showing a state where an action member is located at one side in a widthwise direction.
Figure 8:
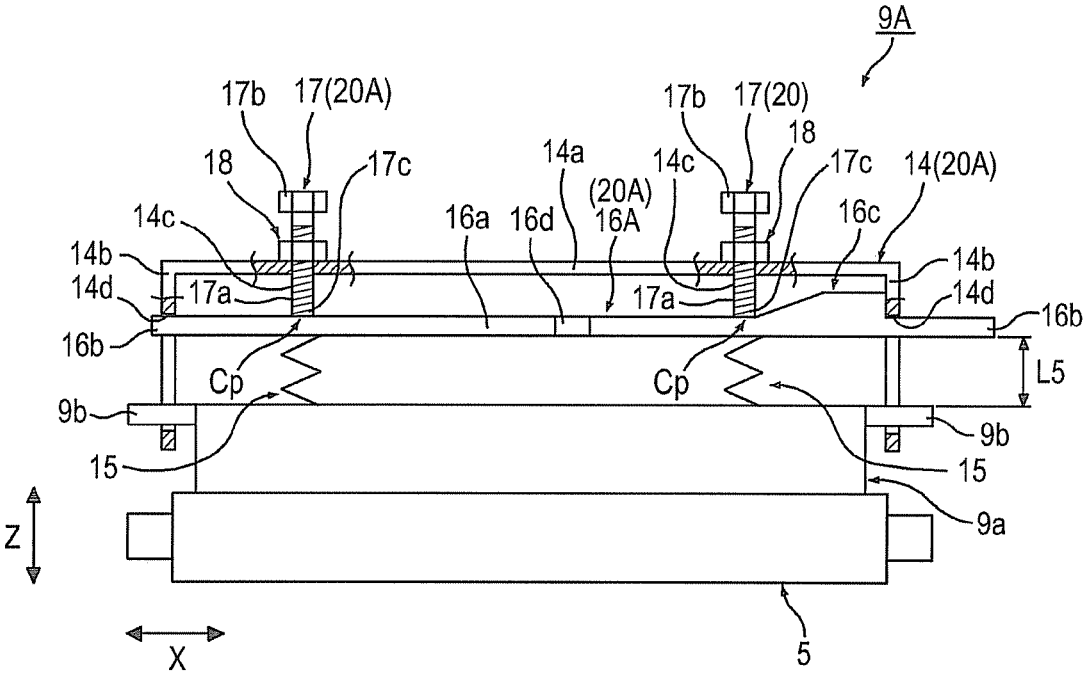
FIG. 8 is a schematic front view (partial sectional view) of the head block of the printer, showing a state where the action member is located at the other side in the widthwise direction.
Figure 9:
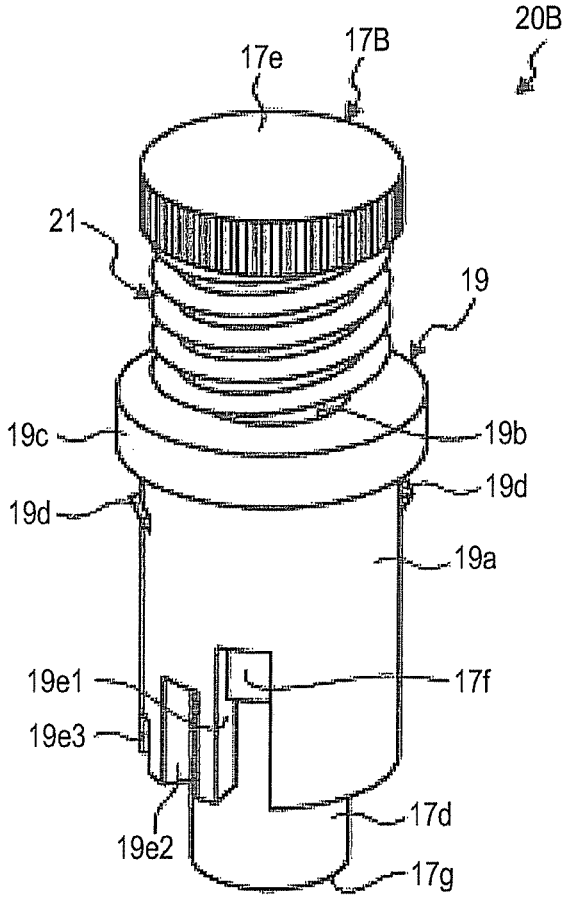
FIG. 9 is a perspective view showing a contact member of a printer according to a third embodiment.

FIGS. 7 and 8 illustrate schematic front views (partial sectional view) of a head block of a printer according to a second embodiment. In this embodiment, as shown in FIGS. 7 and 8, the printer includes a print block 9A in place of the print block 9 of the first embodiment. The print block 9A includes the same components as those of the first embodiment except an action member 16A. In this embodiment, the base member 14, the action member 16A and the screws 17 constitute an urging force adjustment mechanism 20A, which variably sets the length of the coil spring 15, thereby adjusting the urging force of the thermal head 9*a* against the platen roller 5 by means of an elastic force of the coil spring 15.

As shown in the embodiment of FIGS. 7 and 8, a protruding portion 16*c* (used as a protruding section) is formed on the action member 16A, corresponding to one of the screws 17 as the plurality of contact members (e.g., the right one of the two screws 17). Accordingly, in the state shown in FIG. 7, since only the right screw 17 contacts the protruding portion 16*c*, the length L6 of the right coil spring 15 (i.e. the space in which the coil spring 15 is disposed) in the Z direction is smaller than the length L5 of the left coil spring 15 (i.e. the space in which the coil spring 15 is disposed) in the Z direction (i.e., L6<L5). Accordingly, in FIG. 7, the biasing force of the right coil spring 15 is larger than the biasing force of the left coil spring 15. Further, in this case, the urging force of the thermal head 9*a* against the platen roller 5 is larger on the right-hand side of FIG. 7 in the X direction (i.e., the widthwise direction of the strip-shaped paper 2 or the ink ribbon 6), while the urging force is weaker on the left-hand side of FIG. 7 in the X direction. Accordingly, even when a strip-shaped paper 2 having a thickness varying along the X direction is printed, for example, a quality print can be produced by preventing the urging force of the thermal head 9*a* against the platen roller 5 from being dispersed in the X direction.

As shown in FIG. 8, both of the two screws 17 may contact the base section 16*a* of the action member 16A when an operator moves the action member 16A to the right-hand side of FIG. 8. In this case, the lengths L5 of the two coil springs 15 (i.e., the spaces in which the coil springs 15 are disposed) are equal to each other. Thus, the urging force of the thermal head 9*a* applied to the platen roller 5 is substantially constant along the X direction.

The above embodiment may perform the same operation and obtain the same effects as the first embodiment when it is configured to operate in the same manner as the first embodiment. In addition, in this embodiment, the protruding portion 16*c* (used as the protruding section) is provided to correspond to only a portion of the screws 17 (used as the plurality of contact members). Thus, an operator may relatively easily vary the urging force of the thermal head 9*a* applied to the platen roller 5 along the X direction by moving the action member 16A to one side of the X direction (e.g., the left-hand side of FIGS. 7 and 8). This configuration may be advantageous in case where it is pre-determined that one side of the strip-shaped paper 2 in the X direction 2 has a greater thickness than the other side thereof.

In addition, in this embodiment, the protrusion of the protruding portion 16*c* may increase in a stepwise manner along the X direction. Thus, the operator may adjust the length of the coil spring 15 (i.e. the space in which the coil spring 15 is disposed) in the Z direction, thereby adjusting the magnitude of the urging force of the thermal head 9*a* applied to the platen roller 5 by the coil spring 15 as well as the magnitude difference of the urging force in the X direction (e.g., a rate of the magnitude change), by appropriately moving the action member 16A in the X direction.

FIGS. 9 to 12 illustrate a contact member of a printer according to a third embodiment. As shown in FIGS. 9 to 12, the present embodiment has the same configuration as the first and second embodiments except that an urging force adjustment mechanism 20B is provided in place of the urging force adjustment mechanisms 20 and 20A of the first and second embodiments. The urging force adjustment mechanism 20B includes a contact member 17B configured to contact an action member (not shown in FIGS. 9 to 12), e.g., the action member 16 or action member 16A as provided in the first or second embodiment (see FIGS. 2 and 7). The urging force adjustment mechanism 20B further includes a support member 19 configured to support the contact member 17B in a base member 14B, and a coil spring 21 interposed between the contact member 17B and the support member 19. A leading end portion 17*g* of a rod-shaped portion 17*d* of the contact member 17B contacts the base section 16*a* or the protruding portions 16*c* of the action member 16 (or action member 16A). Although not shown in the drawings, the thermal head 9*a*, the platen roller 5 and other elements may be arranged on the lower side of the urging force adjustment mechanism 20B in FIGS. 9 to 12.

The support member 19 includes a tubular section 19*a* and a flange section 19*c* extending from one longitudinal end portion of the tubular section 19*a*. The rod-shaped portion 17*d* of the contact member 17B is inserted in a through-hole 19*b* of the tubular section 19*a*.

Figure 10:
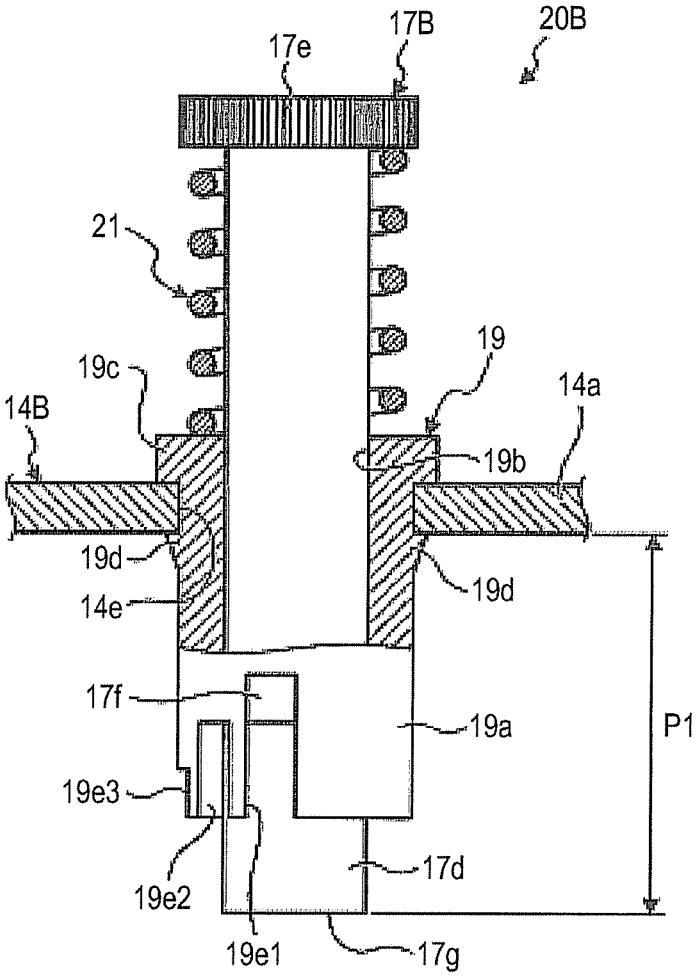
FIG. 10 is a sectional view showing a state where the contact member of the printer of FIG. 9 is supported by a base member.
Figure 11:
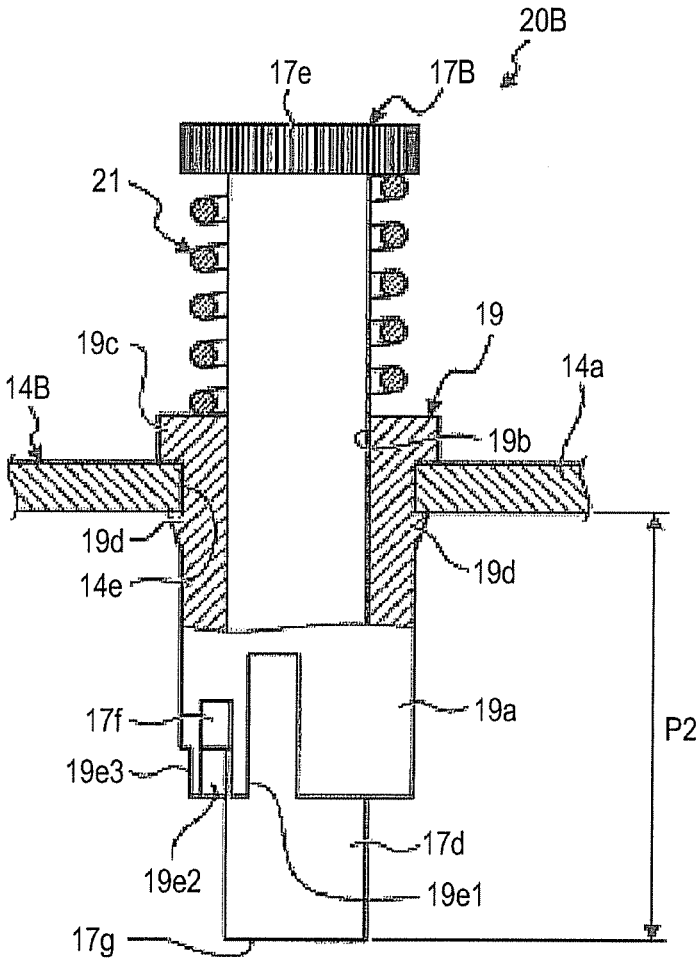
FIG. 11 is a sectional view showing a state where the contact member of the printer is supported by the base member, in which a protrusion length of the contact member towards a thermal head is larger than that in the state shown in FIG. 10.
Figure 12:
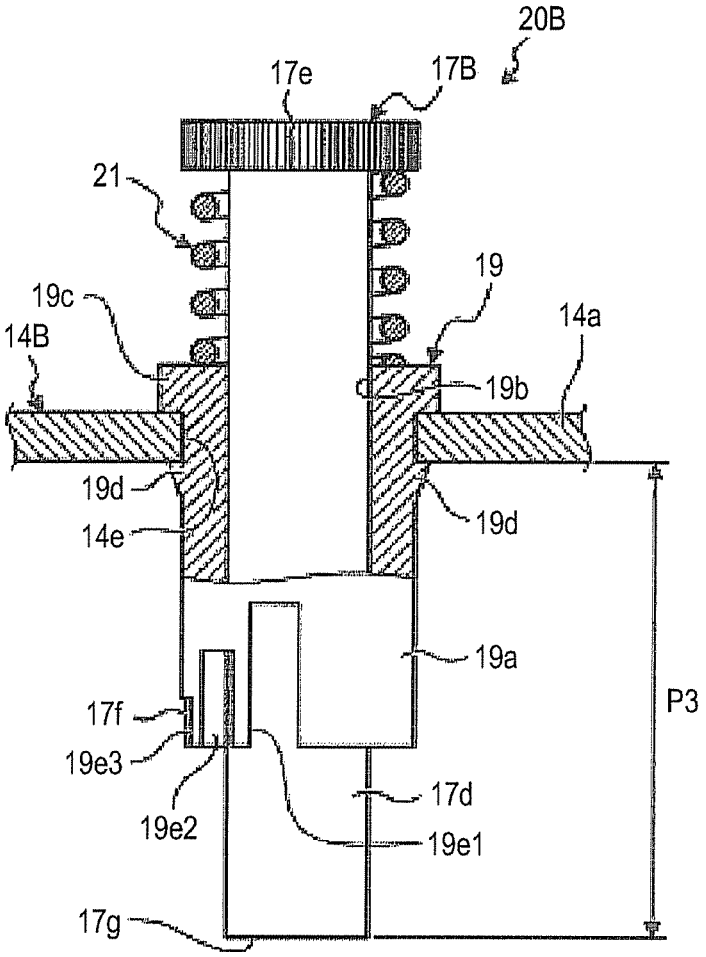
FIG. 12 is a sectional view showing a state where the contact member of the printer is supported by the base member, in which the protrusion length of the contact member toward the thermal head is larger than that in the state shown in FIG. 11.

Nail portions 19*d* are formed on the outer circumference of the tubular section 19*a* with a gap between the nail portions 19*d* and the flange section 19*c*. Further, as shown in FIGS. 10 to 12, the tubular section 19*a* is inserted in a through-hole 14*e* formed on the top wall 14*a* of the base member 14B. The top wall 14*a* (surrounding the through-hole 14*e*) is interposed between the flange section 19*c* and the nail portions 19*d*. In this configuration, the support member 19 is supported by the base member 14B. An operator may insert the support member 19 into the through-hole 14*e* from the upper side in FIGS. 9 to 12 such that the support member 19 is supported by the base member 14B, as shown in FIGS. 9 to 12.

A flange section 17*e* is formed extending outward from one longitudinal end portion of the rod-shaped portion 17*d* of the contact member 17B. Further, the coil spring 21 is arranged around the outer circumference of the rod-shaped portion 17*d* of the contact member 17B between the flange section 17*e* of the contact member 17B and the flange section 19*c* of the support member 19. The coil spring 21 acts as a compression spring and urges the contact member 17B toward the upper side in FIGS. 9 to 12 with respect to the support member 19.

An engagement projection 17*f* is formed on the outer circumference of the rod-shaped portions 17*d* of the contact member 17B. Further, a plurality of cutouts 19*e*1 to 19*e*3 configured to be engaged with the engagement projection 17*f* is formed on the circumference of the other longitudinal end portion of the tubular section 19*a* of the support member 19. In this embodiment, the cutouts 19*e*1 to 19*e*3 have different depths. For example, the cutout 19*e*1 is the deepest, the cutout 19*e*2 is the next deepest and the cutout 19*e*3 is the shallowest.

As shown in FIG. 10, in the state where the engagement projection 17*f* is inserted in and engages with the deepest cutout 19*e*1, the contact member 17B is located at the uppermost position (among the configurations shown in FIGS. 10 to 12). As a result, the protrusion length P1 extending from the top wall 14*a* of the base member 14B to the side of thermal head 9*a* (which the contact member 17B may contact in the bottom side in FIG. 10) is the shortest. Further, as shown in FIG. 11, in the state where the engagement projection 17*f* is inserted in and engages with the second deepest cutout 19*e*2 (shallower than the cutout 19*e*1), the contact member 17B is located closer to the thermal head 9*a* (which the contact member 17B may contact in the bottom side in FIG. 11) than the one shown in FIG. 10. Accordingly, the protrusion length P2 extending from the top wall 14*a* of the base member 14B to the thermal head 9*a* is larger than the protrusion length P1 in the state shown in FIG. 10. In addition, as shown in FIG. 12, in the state where the engagement projection 17*f* is inserted in and engages with the shallowest cutout 19*e*3 (shallower than the cutout 19*e*2), the contact member 17B is located closer to the thermal head 9*a* (which the contact member 17B may contact in the lower side in FIG. 12) than the one shown in FIG. 11. As a result, a protrusion length P3 extending from the top wall 14*a* of the base member 14B to the thermal head 9*a* is larger than the protrusion length P2 in the state shown in FIG. 11.

Accordingly, as shown in FIGS. 10 to 12, an operator can variably set the protrusion length of the rod-shaped portion 17*d* of the contact member 17B by selectively determining which one of the cutouts 19*e*1 to 19*e*3 is engaged with the engagement projection 17*f*. For example, the operator may switch among the states shown in FIGS. 10 to 12 (i.e., a state where the engagement projection 17*b* engages with one of the cutouts 19*e*1 to 19*e*3) as follows. The operator may release the engagement of the engagement projection 17*f* with any one of the cutouts 19*e*1 to 19*e*3 by urging the contact member 17B downward from the upper side in FIGS. 9 to 12 using a finger or the like. Then, the operator may rotate the contact member 17B around its center axis such that the engagement projection 17*f* is located at a position corresponding to one of the cutouts 19*e*1 to 19*e*3, and take the finger or the like off the contact member 17B. According to this embodiment, the operator may easily adjust the protrusion length of the contact member 17B and thus adjust the biasing force of the coil spring 15 (not shown in FIGS. 9 to 12). This allows a variation of the urging force of the thermal head applied along one line of printable area. Further, even if the urging force applied on such area is not uniform, it is possible to prevent the print concentration from being inconsistent along the one line of printable area by adjusting the protrusion length of the contact member 17B. The above embodiment may perform the same operation and obtain the same effects as the first and second embodiments when it is configured to operate in the same manner as the first and second embodiments.

While exemplary embodiments of the present disclosure have been shown and described in the above, various modifications and alterations may be made without being limited to the disclosed embodiments. For example, the thermal head may be biased against the platen roller by a coil spring implemented using an expansion coil. Alternatively, the thermal head may be biased against the platen roller by means of a biasing member such as a leaf spring. In addition, groove portions (including inclined surfaces or steps, etc.) may be formed in the action member in place of the protruding sections such as the protruding portions. In addition, specifications (form, structure, shape, size, length, width, height, thickness, section, weight, number, material, arrangement, position, etc.) of various elements (printer, strip-shaped paper, print medium, thermal head, platen roller, biasing member, urging force adjustment mechanism, base member, action member, contact member, support member, groove portion, protruding section, protruding portion, support section, engagement section, engaged section, engagement projection, cutout, etc.) may be appropriately changed for practice.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a thermal head extending in a widthwise direction of a strip-shaped material;

a platen roller facing the thermal head and extending in the widthwise direction;

a plurality of biasing members arranged apart from each other in the widthwise direction and configured to urge the thermal head against the platen roller by an elastic force made by expansion or compression; and an urging force adjustment mechanism configured to vary the urging force of the thermal head against the platen roller by varying the amount of expansion or compression of the plurality of biasing members, the urging force adjustment mechanism including:

a base member;

an action member movable in the widthwise direction with respect to the base member and configured to expand or compress the plurality of biasing members; and a plurality of contact members configured to contact the action member and supported by the base member such that contact positions of the contact members on the action member can be varied in the expansion or compression direction of the biasing members.

2. The printer of claim 1, wherein the plurality of contact members include a first contact member configured to contact one side of the action member with respect to the center of the thermal head in the widthwise direction and a second contact member configured to contact the other side of the action member with respect to the center of the thermal head in the widthwise direction.

3. The printer of claim 1, wherein the urging force adjustment mechanism further includes at least one of a groove portion and a protruding portion formed on the action member, wherein the groove portion and the protruding portion are formed at one or more of the contact positions of the contact members, and wherein the amount of expansion or compression of the biasing members varies according to the movement of the action member in the widthwise direction with respect to the base member.

4. The printer of claim 3, wherein at least one of the groove portion and the protruding portion is configured to correspond to each of the plurality of contact members.

5. The printer of claim 3, wherein at least one of the groove portion and the protruding portion is configured to correspond to a portion of the plurality of contact members.

6. The printer of claim 1, wherein at least one groove portion formed on the action member is configured to support at least one of the contact members.

7. The printer of claim 1, wherein a plurality of grooves are configured to support at least one of the contact members and wherein the plurality of grooves are formed on the action member at different positions in the expansion or compression direction of the biasing members.

8. The printer of claim 1, wherein the urging force adjustment mechanism further includes:

a plurality of support members configured to support the plurality of contact members in the base member; and a plurality of springs disposed between the plurality of contact members and the plurality of support members and configured to urge the plurality of contact members in the expansion or compression direction of the biasing members.

9. The printer of claim 8, wherein each of the contact members includes an engagement projection and each of the support members includes a plurality of cutouts configured to be engaged with the engagement projection of the contact member supported by the support member, wherein the cutouts of each of the support members have different depths.

10. A printer comprising:

a thermal head extending in a widthwise direction of a strip-shaped material;

a platen roller facing the thermal head and extending in the widthwise direction;

a plurality of biasing members arranged apart from each other in the widthwise direction and configured to urge the thermal head against the platen roller by an elastic force; and an urging force adjustment mechanism configured to vary an urging force of the thermal head against the platen roller by varying the elastic force of the plurality of biasing members, the urging force adjustment mechanism including:

a base member;

an action member movable in the widthwise direction with respect to the base member and configured to expand or compress the plurality of biasing members;

a plurality of contact members configured to contact the action member and supported by the base member; and at least one of a groove portion and a protruding portion formed on the action member at contact positions of the contact members and configured to vary the amount of the elastic force of the biasing members according to the movement of the action member in the widthwise direction with respect to the base member.

11. The printer of claim 10, wherein the plurality of contact members include a first contact member configured to contact one side of the action member with respect to the center of the thermal head in the widthwise direction and a second contact member configured to contact the other side of the action member with respect to the center of the thermal head in the widthwise direction.

12. The printer of claim 10, wherein at least one of the groove portion and the protruding section is configured to correspond to each of the plurality of contact members.

13. The printer of claim 10, wherein at least one of the groove portion and the protruding section is configured to correspond to a portion of the plurality of contact members.

14. The printer of claim 10, wherein at least one groove portion formed on the action member is configured to support at least one of the contact members.

15. The printer of claim 10, wherein a plurality of grooves are configured to support at least one of the contact members and wherein the plurality of grooves are formed on the action member at different positions in the expansion or compression direction of the biasing members.

16. The printer of claim 10, wherein the urging force adjustment mechanism further includes:

a plurality of support members configured to support the plurality of contact members in the base member; and a plurality of springs disposed between the plurality of contact members and the plurality of support members and configured to urge the plurality of contact members in the expansion or compression direction of the biasing members.

17. The printer of claim 16, wherein each of the contact members includes an engagement projection and each of the support members includes a plurality of cutouts configured to be engaged with the engagement projection of the contact member supported by the support member, wherein the cutouts of each of the support members have different depths.

18. A printer comprising:

a thermal head extending in a widthwise direction of a strip-shaped material;

a platen roller facing the thermal head and extending in the widthwise direction;

a plurality of springs arranged apart from each other in the widthwise direction and configured to urge the thermal head against the platen roller by an elastic force; and an urging force adjustment mechanism configured to vary the urging force of the thermal head against the platen roller by varying the elastic force of the plurality of springs, wherein the urging force adjustment mechanism includes:

a base member;

an action member movable in the widthwise direction with respect to the base member and configured to expand or compress the plurality of springs;

a plurality of contact members configured to contact the action member, wherein the contact positions of the contact members on the action member can be varied in the expansion or compression direction of the plurality of springs, and the amount of expansion or compression of the plurality of springs varies according to the variation of the contact positions;

a plurality of support members configured to support the plurality of contact members in the base member; and a plurality of springs disposed between the plurality of contact members and the plurality of support members and configured to urge the plurality of contact members in the expansion or compression direction of the plurality of spring.

* * * * *